US010088764B2

(12) United States Patent
Kamai et al.

(10) Patent No.: US 10,088,764 B2
(45) Date of Patent: Oct. 2, 2018

(54) CARRIER CORE MATERIAL AND ELECTROPHOTOGRAPHIC DEVELOPMENT CARRIER USING SAME AND ELECTROPHOTOGRAPHIC DEVELOPER

(71) Applicants: DOWA ELECTRONICS MATERIALS CO., LTD., Tokyo (JP); DOWA IP CREATION CO., LTD., Okayama-shi, Okayama (JP)

(72) Inventors: Yuto Kamai, Okayama (JP); Takeshi Kawauchi, Okayama (JP)

(73) Assignees: DOWA ELECTRONICS MATERIALS CO., LTD., Tokyo (JP); DOWA IP CREATION CO., LTD., Okayama (JP)

( * ) Notice: Subject to any disclaimer, the term of this patent is extended or adjusted under 35 U.S.C. 154(b) by 0 days.

(21) Appl. No.: 15/555,646

(22) PCT Filed: Mar. 22, 2016

(86) PCT No.: PCT/JP2016/058910
§ 371 (c)(1),
(2) Date: Sep. 5, 2017

(87) PCT Pub. No.: WO2016/158548
PCT Pub. Date: Oct. 6, 2016

(65) Prior Publication Data

US 2018/0046103 A1 Feb. 15, 2018

(30) Foreign Application Priority Data

Mar. 27, 2015 (JP) ..... 2015-065396

(51) Int. Cl.
*G03G 9/08* (2006.01)
*G03G 9/113* (2006.01)
(Continued)

(52) U.S. Cl.
CPC ..... *G03G 9/0827* (2013.01); *G03G 9/0819* (2013.01); *G03G 9/10* (2013.01);
(Continued)

(58) Field of Classification Search
CPC ..... G03G 9/10; G03G 9/107
(Continued)

(56) References Cited

U.S. PATENT DOCUMENTS

2014/0017609 A1 1/2014 Kawauchi et al.

FOREIGN PATENT DOCUMENTS

JP H10-20561 A 1/1998
JP 2000-089518 A 3/2000
(Continued)

OTHER PUBLICATIONS

Jun. 14, 2016 International Search Report issued in International Patent Application No. PCT/JP2016/058910.
(Continued)

*Primary Examiner* — Mark A Chapman
(74) *Attorney, Agent, or Firm* — Oliff PLC

(57) ABSTRACT

A carrier core material includes, a main component, a material represented by a composition formula $Mn_XM_Y Fe_{3-(X+Y)}O_4$ (where M is selected from Mg, Ti, Cu, Zn and Ni, $0<X$, $0\leq Y$, $0<X+Y<1$), in which 0.1 to 1.0 mol % of at least one of Sr element and Ca element is contained as the total amount by conversion to SrO or CaO and in which the frequency of a grain whose length RSm is equal or more than 8.0 μm among grains appearing on the surface of particles of the carrier core material is equal to or less than 2.0 number percent. In this way, the degradation of a carrier caused by long-term use such as the separation of a coating resin is significantly reduced, stable charging performance is maintained and the cracking or chipping of the particles is reduced.

8 Claims, 8 Drawing Sheets

(51) Int. Cl.
*G03G 9/107* (2006.01)
*G03G 9/10* (2006.01)

(52) U.S. Cl.
CPC ..... *G03G 9/107* (2013.01); *G03G 9/1075* (2013.01); *G03G 9/1136* (2013.01)

(58) Field of Classification Search
USPC ..... 430/111.31, 111.32, 111.33
See application file for complete search history.

(56) References Cited

FOREIGN PATENT DOCUMENTS

| | | | |
|---|---|---|---|
| JP | 2006-337579 | A | 12/2006 |
| JP | 2011-008199 | A | 1/2011 |
| JP | 2012-159642 | A | 8/2012 |
| JP | 2012-215681 | A | 11/2012 |
| JP | 2013-178414 | A | 9/2013 |
| JP | 2013-182064 | A | 9/2013 |
| JP | 2013-205614 | A | 10/2013 |
| JP | 2013-231766 | A | 11/2013 |
| JP | 2015-038625 | A | 2/2015 |
| JP | 2015-212788 | A | 11/2015 |

OTHER PUBLICATIONS

Oct. 3, 2017 International Preliminary Report on Patentability issued in International Patent Application No. PCT/JP2016/058910.

CARRIER CORE MATERIAL AND ELECTROPHOTOGRAPHIC DEVELOPMENT CARRIER USING SAME AND ELECTROPHOTOGRAPHIC DEVELOPER

TECHNICAL FIELD

The present invention relates to a carrier core material and an electrophotographic development carrier using such a carrier core material and an electrophotographic developer.

BACKGROUND ART

In an image forming apparatus using an electrophotographic system, such as a facsimile, a printer or a copying machine, a toner is adhered to an electrostatic latent image formed on the surface of a photosensitive member to visualize it, the visualized image is transferred to a sheet or the like and thereafter it is fixed by being heated and pressurized. In terms of achieving high image quality and colorization, as a developer, a so-called two-component developer containing a carrier and a toner is widely used.

In a development system using a two-component developer, a carrier and a toner are agitated and mixed within a development device, and the toner is charged by friction so as to have a predetermined amount. Then, the developer is supplied to a rotating development roller, a magnetic brush is formed on the development roller and the toner is electrically moved to the photosensitive member through the magnetic brush to visualize the electrostatic latent image on the photosensitive member. The carrier after the movement of the toner is left on the development roller, and is mixed again with the toner within the development device. Hence, as the properties of the carrier, a magnetic property for forming the magnetic brush, a charging property for providing a desired charge to the toner and durability in repeated use are required.

As such a carrier, a carrier which is obtained by coating, with a resin, the surface of magnetic particles such as magnetite or various types of ferrites is generally used. In the magnetic particles serving as the carrier core material, not only a satisfactory magnetic property but also a satisfactory friction charging property for the toner is required. As the carrier core material which satisfies the properties described above, carrier core materials having various shapes are proposed.

For example, in patent document 1, an electrophotographic development ferrite carrier core material is proposed which contains Sr and which has a specific shape and a magnetic property. In patent document 2, an electrophotographic development ferrite carrier core material is proposed which has a specific composition, whose lattice constant falls within a specific range and in which a surface oxide coating is formed.

RELATED ART DOCUMENT

Patent Document

Patent Document 1: Japanese Unexamined Patent Application Publication No. 2012-159642

Patent Document 2: Japanese Unexamined Patent Application Publication No. 2013-178414

DISCLOSURE OF THE INVENTION

Problems to be Solved by the Invention

However, the proposed carrier core materials may not cope with image forming apparatuses such as printers in recent years. For example, in a so-called high-speed image forming apparatus or the like which can form 60 to 70 sheets of images per minute, a resin which coats the surface of a carrier core material is separated off due to long-term use, and thus a failure in the charging of a toner occurs, with the result that a deterioration in image quality may be caused. Moreover, cracking or chipping occurs in the carrier core material due to an agitation stress, and thus a failure such as the scattering of a carrier may be caused.

Hence, the present invention is made in view of the conventional problems described above, and an object of the present invention is to provide a carrier core material which significantly reduces the degradation of a carrier such as the separation of a coating resin caused by long-term use, which maintains stable charging performance and which reduces the cracking or chipping of particles.

Another object of the present invention is to provide an electrophotographic development carrier and an electrophotographic developer which can stably form satisfactory quality images even in long-term use.

Means for Solving the Problem

In order to achieve the above objects, according to the present invention, there is provided a carrier core material that includes, a main component, a material which is represented by a composition formula $Mn_XM_YFe_{3-(X+Y)}O_4$ (where M is at least one type of metal selected from a group consisting of Mg, Ti, Cu, Zn and Ni, $0<X$, $0\leq Y$, $0<X+Y<1$), where 0.1 to 1.0 mol % of at least one of Sr element and Ca element is contained as the total amount by conversion to SrO or CaO, and the frequency of a grain whose length RSm is equal or more than 8.0 μm among grains appearing on the surface of particles of the carrier core material is equal to or less than 2.0 number percent. A method of measuring the length RSm of the grains will be described in examples to be discussed later. In the present specification, unless otherwise particularly specified, "to" is used to mean that values mentioned before and after the "to" are included as the lower limit value and the upper limit value.

Here, the average value of the lengths RSm of the grains preferably falls within a range which is equal to or more than 5.5 μm but equal to or less than 6.3 μm.

The volume average particle diameter (hereinafter, also simply referred to as the "average particle diameter") of the carrier core material according to the present invention is preferably equal to or more than 20 μm but equal to or less than 40 μm.

The BET specific surface area of the carrier core material according to the present invention preferably falls within a range which is equal to or more than 0.170 $m^2/g$ but less than 0.225 $m^2/g$.

The pore volume of the carrier core material according to the present invention is preferably equal to or more than 0.003 $cm^3/g$ but equal to or less than 0.020 $cm^3/g$.

The fluidity of the carrier core material according to the present invention preferably falls within a range which is equal to or more than 30 sec/50 g but less than 42 sec/50 g.

Moreover, according to the present invention, there is also provided an electrophotographic development carrier, where the surface of the carrier core material described above is coated with a resin.

Furthermore, according to the present invention, there is also provided an electrophotographic developer including: the electrophotographic development carrier described above; and a toner.

According to the present invention, there is also provided a method of manufacturing a carrier core material, the method including: a step of putting and mixing a Mn component raw material, a M component raw material (where M is at least one type of metal selected from a group consisting of Mg, Ti, Cu, Zn and Ni), a Fe component raw material and a Sr component raw material and/or a Ca component raw material into a dispersant so as to produce a slurry; a step of spraying and drying the slurry so as to obtain a granulated material; and a step of calcining the granulated material so as to obtain a calcined material, where the Mn component raw material whose graphite content is equal to or less than 0.01 wt % is used.

Furthermore, according to the present invention, there is also provided a method of manufacturing a carrier core material, the method including: a step of putting and mixing a Mn component raw material, a M component raw material (where M is at least one type of metal selected from a group consisting of Mg, Ti, Cu, Zn and Ni), a Fe component raw material and a Sr component raw material and/or a Ca component raw material into a dispersant so as to produce a slurry; a step of spraying and drying the slurry so as to obtain a granulated material; and a step of calcining the granulated material so as to obtain a calcined material, where the concentration of oxygen in a step of increasing the temperature to the calcination temperature in the calcination step is set higher than 50000 ppm and where the concentration of oxygen in a step of performing cooling from the calcination temperature is set lower than 50000 ppm.

Advantages of the Invention

In the carrier core material according to the present invention, since a specific concave-convex shape is formed in the surface of particles, when the carrier core material is used as a carrier core material for an electrophotographic image forming apparatus, it is possible to significantly reduce the degradation of a carrier caused by use and thereby use it for a long period of time. Moreover, the stable charging performance is maintained, and the cracking or chipping of the particles is reduced.

In the electrophotographic development carrier and the electrophotographic developer according to the present invention, it is possible to increase the speed of image formation and enhance the image quality.

DESCRIPTION OF EMBODIMENTS

Figure 1:
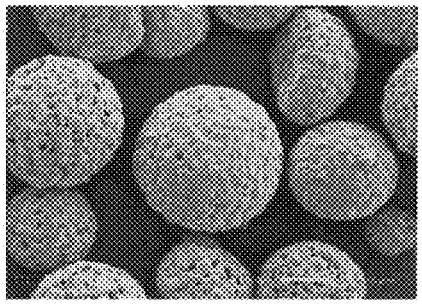
FIG. 1 A partially enlarged SEM photograph of a carrier core material in example 1.

The present inventors et al. have conducted a thorough study for reducing the separation of a coating resin from carrier core material particles and the cracking or chipping of the particles, and consequently have found that a concave-convex shape in the surface of the carrier core material particles is important. Specifically, when concave and convex portions in the surface of the carrier core material particles are small, the resin which coats the surface of the core material particles is easily separated off due to long-term use, with the result that charging provision performance for a toner is lowered. On the other hand, when the concave and convex portions in the surface of the carrier core material particles are large, a large number of carrier core material particles are easily exposed from the coating resin, and thus the resistance of the carrier core material particles themselves are lowered, with the result that the scattering of the carrier occurs. Then, it has also been found that in order to control the concave-convex shape in the surface of the carrier core material particles, a small amount of at least one of Sr element and Ca element is preferably contained as a raw material.

Then, it has also been found that as the concave-convex shape in the surface of the carrier core material particles, attention is focused on the average length RSm which is an index for the size of grains (crystal grains) appearing on the surface of the core material particles, that it is made to fall within a predetermined range and that thus it is possible to achieve the objects described previously, with the result that the present invention is achieved. Specifically, a carrier core material according to the present invention includes, a main component, a material which is represented by a composition formula $Mn_XM_YFe_{3-(X+Y)}O_4$ (where M is at least one type of metal selected from a group consisting of Mg, Ti, Cu, Zn and Ni, $0<X$, $0\leq Y$, $0<X+Y<1$), 0.1 to 1.0 mol % of at least one of Sr element and Ca element is contained as a total amount by conversion to SrO or CaO and the frequency of a grain whose length RSm is equal or more than 8.0 μm among grains appearing on the surface of the particles of the carrier core material is equal to or less than 2.0 number percent.

In the carrier core material of the present invention, it is important to contain 0.1 to 1.0 mol % of at least one of Sr element and Ca element as the total amount by conversion to SrO or CaO. The predetermined amount of Sr element and/or Ca element is contained, and thus in a calcination step, part of a Sr ferrite and/or a Ca ferrite is generated, and a magnetoplumbite crystal structure is formed, with the result that the concave-convex shape in the surface of the carrier core material particles is easily facilitated. When the total amount of Sr element and/or Ca element contained is less than 0.1 mol % by conversion to SrO or CaO, though the sizes of the grains are easily made uniform, the length RSm of the grains may be decreased such that the charging performance is deteriorated. By contrast, when the total amount of Sr element and/or Ca element contained exceeds 1.0 mol % by conversion to SrO or CaO, abnormal growth may occur in the grains of the carrier core material particles. More preferably, the total amount of Sr element and/or Ca element contained falls within a range of 0.5 to 0.7 mol % by conversion to SrO or CaO.

In addition, it is also important that the frequency of the grain whose length RSm is equal or more than 8.0 μm among the grains appearing on the surface of the particles of the carrier core material be equal to or less than 2.0 number percent. When a large number of grains whose RSm is equal or more than 8.0 μm are present, the separation of the coating resin easily occurs. In particular, when a thin layer of the coating resin is formed on the surface of the carrier core material particles, the separation of the coating resin remarkably occurs.

In the carrier core material of the present invention, the average value of the lengths RSm of the grains appearing on the surface of the particles of the carrier core material preferably falls within a range which is equal to or more than 5.5 μm but equal to or less than 6.3 μm. The small concave and convex portions described above are formed in the surface of the carrier core material particles, and thus when the surface of the carrier core material particles is coated with the resin, it is possible to uniformly coat the surface with the coating resin, with the result that the separation is unlikely to occur even in long-term use. Even when part of the coating resin is separated, a decrease in the charging provision performance for the toner is reduced by the coating resin left in the concave portions. Furthermore, the cracking or chipping of the carrier core material particles is also reduced.

Although the volume average particle diameter of the carrier core material of the present invention is not particularly limited, the volume average particle diameter preferably falls within a range of 20 μm to 40 μm. When the volume average particle diameter is equal to or more than 20 μm, an image failure caused by the scattering of the carrier is preferably prevented from occurring. When the volume average particle diameter is equal to or less than 40 μm, a toner whose particle diameter is small can be preferably used such that it is possible to enhance the image equality. The particle size distribution thereof is preferably sharp.

The BET specific surface area of the carrier core material of the present invention is preferably equal to or more than 0.170 $m^2/g$ but less than 0.225 $m^2/g$. The pore volume thereof is preferably equal to or more than 0.003 $cm^3/g$ but equal to or less than 0.020 $cm^3/g$. This is because the pore volume is smaller than that of a conventional carrier core material, and the BET specific surface area is larger than that of the conventional carrier core material, and thus an appropriate concave-convex shape is formed in the surface of the carrier core material particles, and sintering within the carrier core material particles is sufficiently facilitated. The carrier core material described above has high strength.

The fluidity of the carrier core material of the present invention preferably falls within a range which is equal to or more than 30 sec/50 g but less than 42 sec/50 g. When the fluidity is less than 30 sec/50 g, the friction of the carrier and the toner at the time of the agitation of the developer is reduced, and thus it is impossible to obtain a sufficient charging property. On the other hand, when the fluidity is equal to or more than 42 sec/50 g, the mixing with the toner is degraded, and thus density unevenness occurs.

Although a method of manufacturing the carrier core material of the present invention is not particularly limited, a manufacturing method which will be described below is preferable.

First, a Fe component raw material, a Mn component raw material, a M component raw material and as an additive, a Sr component raw material and/or a Ca component raw material are weighed, are put into a dispersion medium and are mixed, and thus slurry is produced.

Here, as a method of performing control such that the length RSm of the grains appearing on the surface of the carrier core material particles falls within the specified range, the amount of graphite contained in the Mn component raw material is preferably set equal to or less than 0.01 wt %. When the amount of graphite contained in the Mn component raw material exceeds 0.01 wt %, in the calcination step, carbon and oxygen are bound together so as to generate carbon dioxide or carbon monoxide, and thus the calcination atmosphere is converted into a reducing atmosphere. In this way, in a ferrite formation reaction, local reduction occurs, the grains are rapidly grown and thus the RSm is excessively increased so as to exceed the predetermined range.

Here, M is at least one type of metal element selected from a group of divalent metal elements consisting of Mg, Ti, Cu, Zn and Ni. As the Fe component raw material, $Fe_2O_3$ or the like is preferably used. As the Mn component raw material, $MnCO_3$, $Mn_3O_4$ or the like is preferably used. As the M component raw material, for Mg, MgO, $Mg(OH)_2$ or $MgCO_3$ is preferably used. As the Sr component raw material, SrO, $SrCO_3$ or the like is preferably used, and as the Ca component raw material, CaO, $Ca(OH)_2$, $CaCO_3$ or the like is preferably used. The M component is mainly used for adjusting the magnetic property of the carrier, and thus components suitable for the desired magnetic property are preferably selected and mixed. The component little affects the concave and convex portions. The individual component raw materials are milled and mixed as necessary and are thereafter pre-calcined, and thus they may be put into the dispersion medium so as to produce the slurry.

As the dispersion medium used in the present invention, water is preferable. The individual component raw materials and as necessary a binder, a dispersant and the like may be mixed into the dispersion medium. As the binder, for example, polyvinyl alcohol can be preferably used. As the amount of binder mixed, the concentration of the binder in the slurry is preferably set to about 0.5 to 2 mass %. As the dispersant, for example, polycarboxylic acid ammonium or the like can be preferably used. As the amount of dispersant mixed, the concentration of the dispersant in the slurry is preferably set to about 0.5 to 2 mass %. In addition, a lubricant, a sintering accelerator and the like may be mixed. The solid content concentration of the slurry preferably falls within a range of 50 to 90 mass %. The solid content concentration of the slurry more preferably falls within a range of 60 to 80 mass %. When the solid content concentration of the slurry is equal to or more than 60 mass %, a small number of pores within the particles are produced in the granulated material, and thus it is possible to prevent insufficient sintering at the time of the calcination. On the other hand, when the solid content concentration of the slurry is equal to or less than 80 mass %, a small number of bound particles are produced, and thus it is possible to prevent the fluidity from being degraded due to the shape of particles.

Then, the slurry produced as described above is wet-milled. For example, a ball mill or a vibration mill is used to perform wet-milling for a predetermined time. The volume average particle diameter of the milled raw materials is preferably equal to or less than 10 μm and is more preferably equal to or less than 2 μm. A particle diameter $D_{90}$ in 90% volume particle size distribution preferably falls within a range of 1.5 to 4.0 μm. Preferably, when the particle diameter $D_{90}$ is equal to or more than 1.5 μm, it is possible to form small concave and convex portions in the surface of the particles. On the other hand, when the particle diameter $D_{90}$ is equal to or less than 4.0 μm, coarse particles are sufficiently milled, and thus it is possible to prevent abnormal crystal particle growth at the time of the calcination. Within the vibration mill or the ball mill, a medium having a predetermined particle diameter is preferably provided. Examples of the material of the medium include an iron-based chromium steel and an oxide-based zirconia, titania and alumina. As the form of the milling step, either of a continuous type and a batch type may be used. The particle diameter of the milled material is adjusted such as by a milling time, a rotation speed, the material and the particle diameter of the medium used.

Then, the milled slurry is granulated by being sprayed and dried. Specifically, the slurry is introduced into a spray drying machine such as a spray dryer, is sprayed into the atmosphere and is thereby granulated into a spherical shape. The temperature of the atmosphere at the time of the spray drying preferably falls within a range of 100 to 300° C. In this way, it is possible to obtain a spherical granulated material having a particle diameter of 10 to 200 μm. Preferably, for the obtained granulated material, a vibrating screen or the like is used, and thus coarse particles and fine powder are removed such that the particle size distribution becomes sharp. The volume average particle diameter of the granulated material preferably falls within a range of 20 to 40 μm.

Then, the granulated material is put into a furnace heated to a predetermined temperature, and is calcined by a general method for synthesizing the carrier core material. The calcination temperature preferably falls within a range of 1050 to 1200° C. When the calcination temperature is equal to or less than 1050° C., it is unlikely that phase transformation occurs and that sintering proceeds, large convex portions are prevented from being formed on the surface of the particles and a large number of pores are formed within the particles. When the calcination temperature exceeds 1200° C., excessive grains may be generated by excessive sintering. The rate of temperature increase to the calcination temperature preferably falls within a range of 250 to 500° C./h.

Here, as the method of performing control such that the length RSm of the grains appearing on the surface of the carrier core material particles falls within the specified range, instead of the above-described method of decreasing the amount of graphite contained in the Mn component raw material, the oxygen concentration in the calcination step may be controlled. Specifically, preferably, the oxygen concentration in a step of increasing the temperature to the calcination temperature is set higher than 50000 ppm, and the oxygen concentration in a step of performing cooling from the calcination temperature is set lower than 50000 ppm. The oxygen concentration in the temperature increasing step is set high, and thus the binding of the graphite contained in the Mn component raw material with oxygen is facilitated, with the result that in the ferrite formation reaction, the local generation of a reducing atmosphere caused by the remaining graphite is reduced. The oxygen concentration in the cooling step is set low, and thus it is possible to keep the generated ferrite phase.

The calcined material obtained as described above is disintegrated as necessary. Specifically, for example, a hammer mill or the like is used to disintegrate the calcined material. As the form of the disintegration step, either of a continuous type and a batch type may be used. Then, as necessary, classification may be performed such that the particle diameters are made to fall within a predetermined range. As a classification method, a conventional known method such as air classification or sieve classification can be used. After primary classification is performed with an air classifier, with a vibration sieve or an ultrasonic sieve, the particle diameters may be made to fall within the predetermined range. The volume average particle diameter of the precursor preferably falls within a range of 20 to 40 μm.

Thereafter, as necessary, the carrier core material after the classification is heated in an oxidizing atmosphere, and thus an oxide film is formed on the surface of the particles of the carrier core material, with the result that the resistance of the particles may be increased (resistance increasing processing). As the oxidizing atmosphere, either of the atmosphere and the mixed atmosphere of oxygen and nitrogen may be used. The heating temperature preferably falls within a range of 200 to 800° C., and more preferably falls within a range of 250 to 600° C. The heating time preferably falls within a range of 0.5 to 5 hours.

When the carrier core material of the present invention produced as described above is used as an electrophotographic development carrier, though the carrier core material can be used as the electrophotographic development carrier without being processed, in terms of charging property and the like, the carrier core material is used by coating the surface of the carrier core material with a resin.

As the resin with which the surface of the carrier core material is coated, a conventional known resin can be used. Examples thereof include polyethylene, polypropylene, polyvinyl chloride, poly-4-methylpentene-1, polyvinylidene chloride, ABS (acrylonitrile-butadiene-styrene) resin, polystyrene, (meth) acrylic-based resin, polyvinyl alcohol-based resin, thermoplastic elastomers such as polyvinyl chloride-based, polyurethane-based, polyester-based, polyamide-based and polybutadiene-based thermoplastic elastomers and fluorine silicone-based resins.

In order to coat the surface of the carrier core material with the resin, a solution of the resin or a dispersion solution is preferably applied to the carrier core material. As a solvent for the coating solution, one or two or more types of the followings can be used: aromatic hydrocarbon-based solvents such as toluene and xylene; ketone-based solvents such as acetone, methyl ethyl ketone, methyl isobutyl ketone and cyclohexanone; cyclic ether-based solvents such as tetrahydrofuran and dioxane; alcohol-based solvents such as ethanol, propanol and butanol; cellosolve-based solvents such as ethyl cellosolve and butyl cellosolve; ester-based solvents such as ethyl acetate and butyl acetate; and amide-based solvents such as dimethyl formamide and dimethylacetamide. The concentration of the resin component in the coating solution generally falls within a range of 0.001 to 30 mass %, and particularly preferably falls within a range of 0.001 to 2 mass %.

As a method of coating the carrier core material with the resin, for example, a spray dry method, a fluidized bed method, a spray dry method using a fluidized bed and a dipping method can be used. Among them, the fluidized bed method is particularly preferable because it is possible to efficiently perform coating even with a small amount of resin. For example, in the case of the fluidized bed method, the amount of resin applied can be adjusted by the amount of resin solution sprayed and a spraying time.

With respect to the volume average particle diameter of the carrier, its volume average particle diameter generally falls within a range of 20 to 40 μm.

The electrophotographic developer according to the present invention is formed by mixing the carrier produced as described above and the toner. The mixing ratio between the carrier and the toner is not particularly limited, and is preferably determined, as necessary, from development conditions of a development device used or the like. In general, the concentration of the toner in the developer preferably falls within a range of 1 to 15 mass %. This is because when the concentration of the toner is less than 1 mass %, an image density is excessively lowered whereas when the concentration of the toner exceeds 15 mass %, the toner is scattered within the development device, and thus a stain within an apparatus may be produced or a failure may occur in which the toner is adhered to a background part of transfer paper or the like. The concentration of the toner more preferably falls within a range of 3 to 10 mass %.

As the toner, a toner can be used which is manufactured by a conventional known method such as a polymerization method, a milling/classification method, a melting granulation method or a spray granulation method. Specifically, a toner can be preferably used in which a coloring agent, a mold release agent, a charge control agent and the like are contained in a binder resin whose main component is a thermoplastic resin.

With respect to the particle diameter of the toner, in general, its volume average particle diameter by a coulter counter preferably falls within a range of 1 to 15 μm, and more preferably falls within a range of 5 to 12 μm.

A modifier may be added to the surface of the toner as necessary. Examples of the modifier include silica, alumina, zinc oxide, titanium oxide, magnesium oxide and polymethyl methacrylate. One or two or more types thereof can be combined and used.

The mixing of the carrier and the toner can be performed with a conventional known mixing device. For example, a Henschel mixer, a V-type mixer, a tumbler mixer and a hybridizer can be used.

Figure 21:
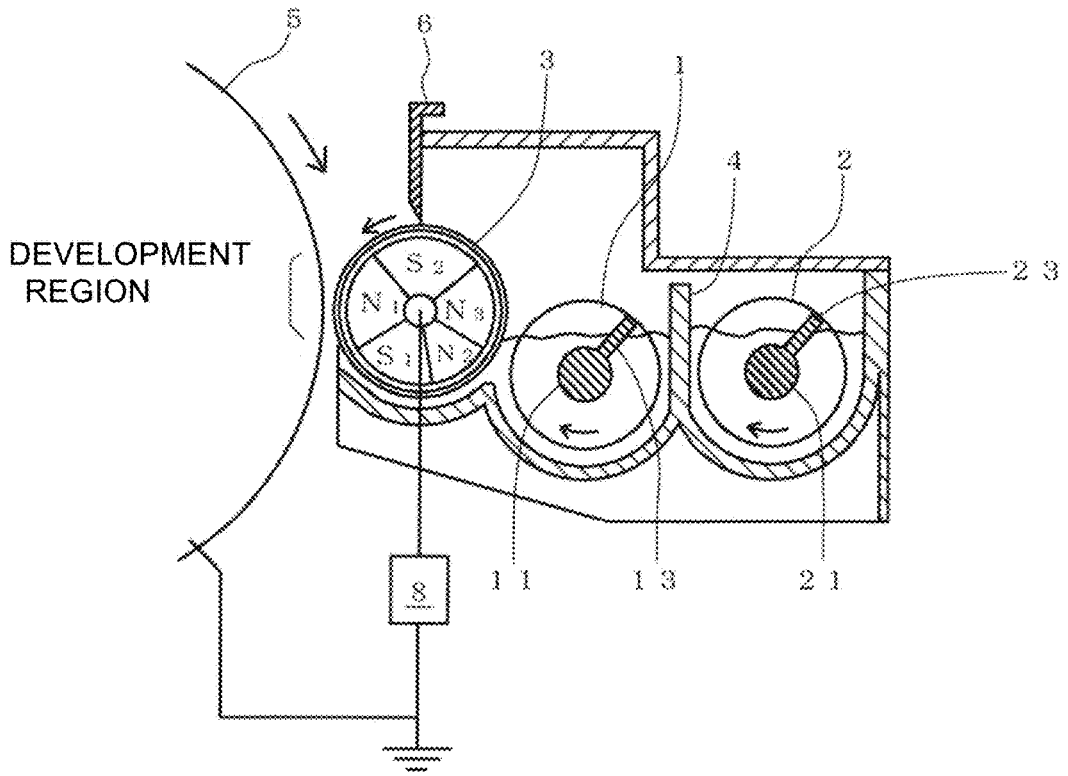
FIG. 21 A diagram schematically illustrating an example of a development device which uses a carrier according to the present invention.

Although a development method using the developer of the present invention is not particularly limited, a magnetic brush development method is preferably used. FIG. 21 shows a diagram schematically illustrating an example of a development device which performs magnetic brush development. The development device shown in FIG. 21 includes: a development roller 3 which incorporates a plurality of magnetic poles and which is freely rotatable; a regulation blade 6 which regulates the amount of developer on the development roller 3 transported to a development portion; two screws 1 and 2 which are arranged parallel to a horizontal direction and which respectively agitate and transport the developer in opposite directions; and a partition plate 4 which is formed between the two screws 1 and 2, which makes it possible to move the developer from one screw to the other screw at both end portions of the screws and which prevents the movement of the developer in the portions other than both the end portions.

In the two screws 1 and 2, spiral blades 13 and 23 are formed at the same inclination angles on shaft portions 11 and 21 and are rotated by an unillustrated drive mechanism in the same direction so as to respectively transport the developer in the opposite directions. At both the end portions of the screws 1 and 2, the developer is moved from one screw to the other screw. In this way, the developer formed with the toner and the carrier is constantly circulated and agitated within the device.

On the other hand, the development roller 3 includes a fixed magnet where within a metallic cylindrical member having concave and convex portions of a few micrometers in its surface, as a magnetic pole generating means, five magnetic poles of a development magnetic pole $N_1$, a transport magnetic pole $S_1$, a separation magnetic pole $N_2$, a pumping magnetic pole $N_3$ and a blade magnetic pole $S_2$ are sequentially arranged. When the development roller 3 is rotated in a direction indicated by an arrow, the developer is pumped up by the magnetic force of the pumping magnetic pole $N_3$ from the screw 1 to the development roller 3. The developer carried on the surface of the development roller 3 is regulated in layer by the regulation blade 6 and is thereafter transported to the development region.

In the development region, a bias voltage obtained by superimposing an alternating-current voltage on a direct-current voltage is applied from a transfer voltage power supply 8 to the development roller 3. The direct-current voltage component of the bias voltage is set to a potential between the potential of a background portion and the potential of an image portion on the surface of a photosensitive drum 5. The potential of the background portion and the potential of the image portion are set to potentials between the maximum value and the minimum value of the bias voltage. The peak-to-peak voltage of the bias voltage preferably falls within a range of 0.5 to 5 kV, and the frequency preferably falls within a range of 1 to 10 kHz. The waveform of the bias voltage may be any waveform such as a rectangular wave, a sine wave or a triangular wave. In this way, the toner and the carrier are vibrated in the development region, the toner is adhered to an electrostatic latent image on the photosensitive drum 5 and thus the development is performed.

Thereafter, the developer on the development roller 3 is transported by the transport magnetic pole $S_1$ into the device, is separated by the separation magnetic pole $N_2$ from the development roller 3, is circulated and transported again by the screws 1 and 2 within the device and is agitated and mixed with the developer which is not subjected to the development. Then, the developer is newly supplied by the pumping magnetic pole $N_3$ from the screw 1 to the development roller 3.

Although in the embodiment shown in FIG. 21, the number of magnetic poles incorporated in the development roller 3 is five, the number of magnetic poles may naturally be increased to 8, 10 or 12 so that the amount of movement of the developer in the development region is further increased or that the pumping property or the like is further enhanced.

EXAMPLES

Example 1

MnMg ferrite particles were produced by the following method. As starting raw materials, 42.6 mol of $Fe_2O_3$ (average particle diameter: 0.6 μm), 38.3 mol of $Mn_2O_3$ (average particle diameter: 0.9 μm) by conversion to MnO, 5.7 mol of MgO (average particle diameter: 0.8 μm) and 0.5 mol of $CaCO_3$ (average particle diameter: 0.8 μm) were dispersed in water, and as a dispersant, 0.6 wt % of an ammonium polycarboxylate-based dispersant was added, with the result that a mixture was formed. The solid content concentration of the mixture was 75 wt %. $Mn_2O_3$ in which the graphite content was 0.01 wt % was used.

The mixture was subjected to milling processing with a wet ball mill (medium diameter of 2 mm), and thus mixed slurry was obtained. The mixed slurry was sprayed with a spray drier into hot air of about 130° C., and thus a dried granulated material having a particle diameter of 10 to 75 μm was obtained. Coarse particles were separated from the granulated material with a sieve whose mesh was 54 μm, and fine particles were separated with a sieve whose mesh was 33 μm.

The granulated material was put into an electric furnace, and the temperature thereof was increased to 1100° C. in 5 hours. Thereafter, the granulated material was held at 1100° C. for 3 hours, and thus calcination was performed. Then, the granulated material was cooled to room temperature in 8 hours. A gas obtained by mixing oxygen and nitrogen was supplied into the furnace such that the concentration of oxygen within the electric furnace in the temperature increasing step and the step of holding the calcination temperature was 12000 ppm and that the concentration of oxygen in the cooling step was 12000 ppm.

The calcined material obtained was disintegrated with a hammer mill and was thereafter classified with a vibration sieve, and thus the calcined material whose average particle diameter was 27.1 μm was obtained.

Then, the calcined material obtained was held under the atmosphere at 500° C. for 1.5 hours, and thus oxidation processing (resistance increasing processing) was performed, with the result that a carrier core material was obtained.

The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 1 shows a SEM photograph of the carrier core material in example 1.

Example 2

Figure 2:
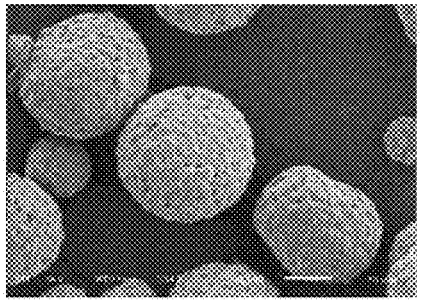
FIG. 2 A partially enlarged SEM photograph of a carrier core material in example 2.

A carrier core material having an average particle diameter of 28.3 μm was obtained by the same method as in example 1 except that the calcination temperature was set to 1110° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 2 shows a SEM photograph of the carrier core material in example 2.

Example 3

Figure 3:
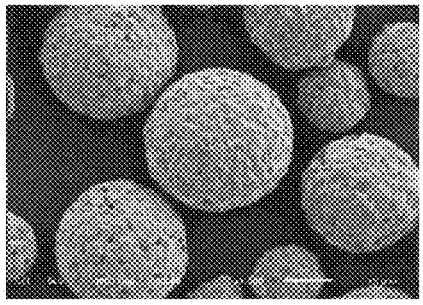
FIG. 3 A partially enlarged SEM photograph of a carrier core material in example 3.

A carrier core material having an average particle diameter of 26.1 μm was obtained by the same method as in example 1 except that the calcination temperature was set to 1120° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 3 shows a SEM photograph of the carrier core material in example 3.

Example 4

Figure 4:
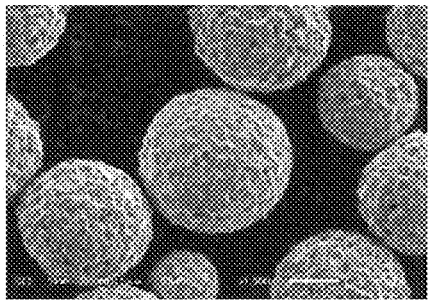
FIG. 4 A partially enlarged SEM photograph of a carrier core material in example 4.

A carrier core material having an average particle diameter of 30.1 μm was obtained by the same method as in example 1 except that as a Mn component raw material, $Mn_3O_4$ ("Mox-Pu" made by Mizushima Ferroalloy Co., Ltd., graphite content: 0.42 wt %) was used and that a gas obtained by mixing oxygen and nitrogen was supplied into the furnace such that the concentration of oxygen within the electric furnace in a temperature increasing step in a calcination step and a step of holding the calcination temperature was 210000 ppm and that the concentration of oxygen in a cooling step was 12000 ppm. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 4 shows a SEM photograph of the carrier core material in example 4.

Example 5

Figure 5:
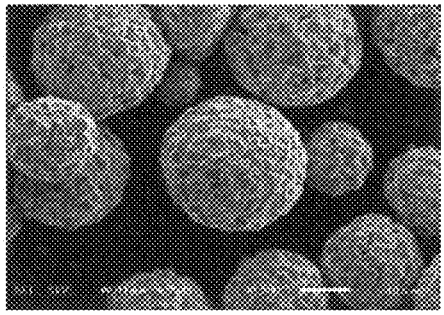
FIG. 5 A partially enlarged SEM photograph of a carrier core material in example 5.

A carrier core material having an average particle diameter of 29.8 μm was obtained by the same method as in example 1 except that as the Mn component raw material, $Mn_3O_4$ ("Mox-Pu" made by Mizushima Ferroalloy Co., Ltd., graphite content: 0.42 wt %) was used, that the calcination temperature was set to 1110° C. and that a gas obtained by mixing oxygen and nitrogen was supplied into the furnace such that the concentration of oxygen within the electric furnace in the temperature increasing step and the step of holding the calcination temperature was 210000 ppm and that the concentration of oxygen in the cooling step was 12000 ppm. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 5 shows a SEM photograph of the carrier core material in example 5.

Example 6

Figure 6:
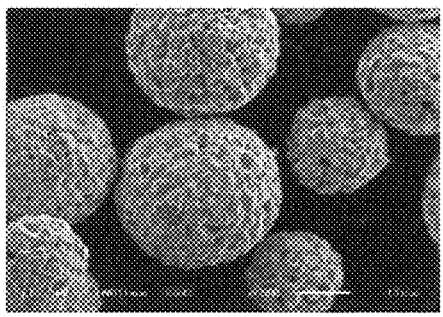
FIG. 6 A partially enlarged SEM photograph of a carrier core material in example 6.

A carrier core material having an average particle diameter of 30.2 μm was obtained by the same method as in example 1 except that as the Mn component raw material, $Mn_3O_4$ ("Mox-Pu" made by Mizushima Ferroalloy Co., Ltd., graphite content: 0.42 wt %) was used, that the calcination temperature was set to 1120° C. and that a gas obtained by mixing oxygen and nitrogen was supplied into the furnace such that the concentration of oxygen within the electric furnace in the temperature increasing step and the step of holding the calcination temperature was 210000 ppm and that the concentration of oxygen in the cooling step was 12000 ppm. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 6 shows a SEM photograph of the carrier core material in example 6.

Example 7

Mn ferrite particles were produced by the following method. As starting raw materials, 54.8 mol of $Fe_2O_3$ (average particle diameter: 0.6 μm), 44.7 mol of $Mn_3O_4$ (average particle diameter: 0.9 μm) by conversion to MnO and 0.5 mol of $SrCO_3$ (average particle diameter: 0.8 μm) were dispersed in water, and as a dispersant, 0.6 wt % of an ammonium polycarboxylate-based dispersant was added, with the result that a mixture was formed. The solid content concentration of the mixture was 80 wt %. As $Mn_3O_4$, "Mox-Pu" made by Mizushima Ferroalloy Co., Ltd. (graphite content: 0.25 wt %) was used.

The mixture was subjected to milling processing with a wet ball mill (medium diameter of 2 mm), and thus mixed slurry was obtained. The mixed slurry was sprayed with a spray drier into hot air of about 130° C., and thus a dried granulated material having a particle diameter of 10 to 75 μm was obtained. Coarse particles were separated from the granulated material with a sieve whose mesh was 54 μm, and fine particles were separated with a sieve whose mesh was 33 μm.

The granulated material was put into the electric furnace, and the temperature thereof was increased to 1100° C. in 5 hours. Thereafter, the granulated material was held at 1100° C. for 3 hours, and thus calcination was performed. Then, the granulated material was cooled to room temperature in 8 hours. A gas obtained by mixing oxygen and nitrogen was supplied into the furnace such that the concentration of oxygen within the electric furnace in the temperature increasing step and the step of holding the calcination temperature was 210000 ppm and that the concentration of oxygen in the cooling step was 7000 ppm.

The calcined material obtained was disintegrated with a hammer mill and was thereafter classified with a vibration sieve, and thus the calcined material whose average particle diameter was 35.6 μm was obtained.

Then, the calcined material obtained was held under the atmosphere at 400° C. for 1.5 hours, and thus oxidation processing (resistance increasing processing) was performed, with the result that a carrier core material was obtained.

Figure 7:
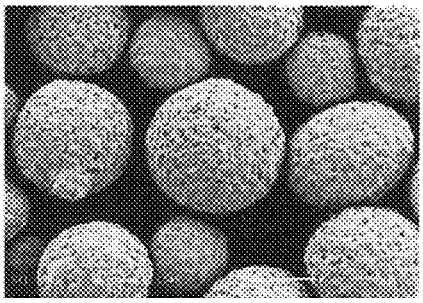
FIG. 7 A partially enlarged SEM photograph of a carrier core material in example 7.

The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 7 shows a SEM photograph of the carrier core material in example 7.

Example 8

Figure 8:
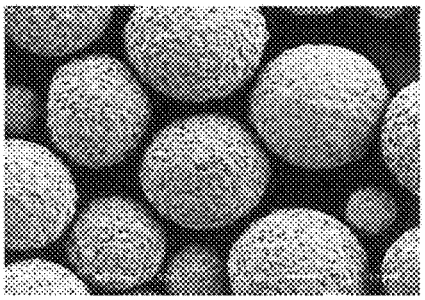
FIG. 8 A partially enlarged SEM photograph of a carrier core material in example 8.

A carrier core material having an average particle diameter of 36.0 μm was obtained by the same method as in example 7 except that the calcination temperature was set to 1110° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 8 shows a SEM photograph of the carrier core material in example 8.

Example 9

Figure 9:
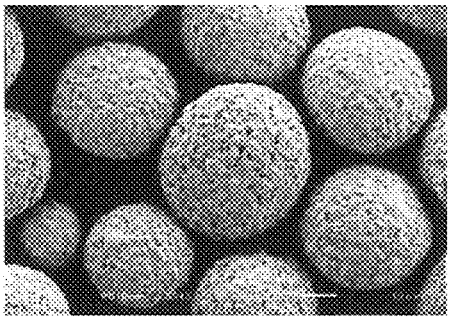
FIG. 9 A partially enlarged SEM photograph of a carrier core material in example 9.

A carrier core material having an average particle diameter of 35.1 μm was obtained by the same method as in example 7 except that the calcination temperature was set to 1120° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 9 shows a SEM photograph of the carrier core material in example 9.

Example 10

MnMg ferrite particles were produced by the following method. As starting raw materials, 50.0 mol of $Fe_2O_3$ (average particle diameter: 0.6 μm), 38.0 mol of $Mn_3O_4$ (average particle diameter: 0.9 μm) by conversion to MnO, 11.0 mol of MgO (average particle diameter: 0.8 μm) and 0.7 mol of $SrCO_3$ (average particle diameter: 0.8 μm) were dispersed in water, and as a dispersant, 0.6 wt % of an ammonium polycarboxylate-based dispersant was added, with the result that a mixture was formed. The solid content concentration of the mixture was 80 wt %. As $Mn_3O_4$, "Mox-Pu" made by Mizushima Ferroalloy Co., Ltd. (graphite content: 0.57 wt %) was used.

The mixture was subjected to milling processing with a wet ball mill (medium diameter of 2 mm), and thus mixed slurry was obtained. The mixed slurry was sprayed with a spray drier into hot air of about 130° C., and thus a dried granulated material having a particle diameter of 10 to 75 μm was obtained. Coarse particles were separated from the granulated material with a sieve whose mesh was 54 μm, and fine particles were separated with a sieve whose mesh was 33 μm.

The granulated material was put into the electric furnace, and the temperature thereof was increased to 1095° C. in 5 hours. Thereafter, the granulated material was held at 1095° C. for 3 hours, and thus calcination was performed. Then, the granulated material was cooled to room temperature in 8 hours. A gas obtained by mixing oxygen and nitrogen was supplied into the furnace such that the concentration of oxygen within the electric furnace in the temperature increasing step and the step of holding the calcination temperature was 210000 ppm and that the concentration of oxygen in the cooling step was 7000 ppm.

The calcined material obtained was disintegrated with a hammer mill and was thereafter classified with a vibration sieve, and thus the calcined material whose average particle diameter was 38.2 μm was obtained.

Then, the calcined material obtained was held under the atmosphere at 470° C. for 1.5 hours, and thus oxidation processing (resistance increasing processing) was performed, with the result that a carrier core material was obtained.

Figure 10:
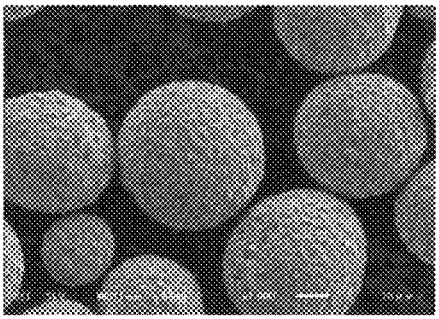
FIG. 10 A partially enlarged SEM photograph of a carrier core material in example 10.

The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 10 shows a SEM photograph of the carrier core material in example 10.

Example 11

Figure 11:
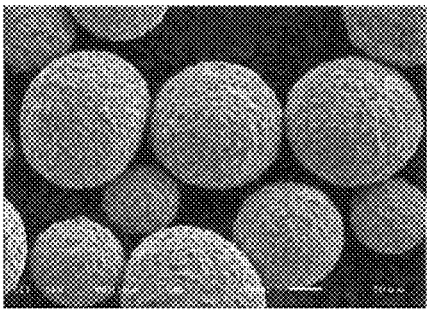
FIG. 11 A partially enlarged SEM photograph of a carrier core material in example 11.

A carrier core material having an average particle diameter of 37.3 μm was obtained by the same method as in example 10 except that the calcination temperature was set to 1105° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 11 shows a SEM photograph of the carrier core material in example 11.

Example 12

Figure 12:
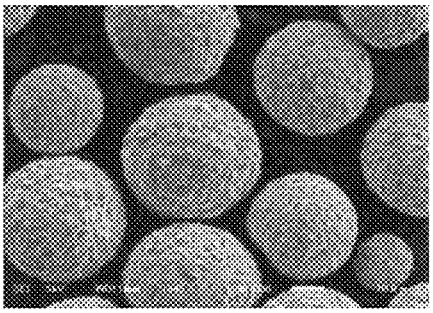
FIG. 12 A partially enlarged SEM photograph of a carrier core material in example 12.

A carrier core material having an average particle diameter of 38.5 μm was obtained by the same method as in example 10 except that the calcination temperature was set to 1115° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 12 shows a SEM photograph of the carrier core material in example 12.

Comparative Example 1

Figure 13:
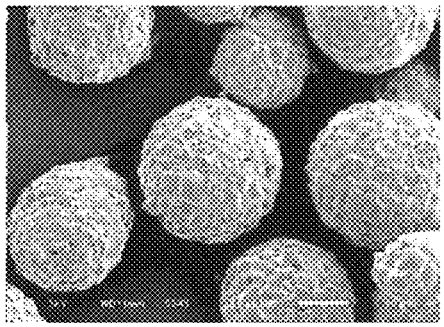
FIG. 13 A partially enlarged SEM photograph of a carrier core material in comparative example 1.

A carrier core material having an average particle diameter of 30.2 μm was obtained by the same method as in example 1 except that as the Mn component raw material, $Mn_3O_4$ ("Mox-Pu" made by Mizushima Ferroalloy Co., Ltd., graphite content: 0.42 wt %) was used. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 13 shows a SEM photograph of the carrier core material in comparative example 1.

Comparative Example 2

Figure 14:
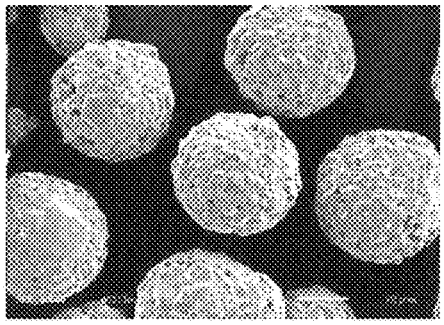
FIG. 14 A partially enlarged SEM photograph of a carrier core material in comparative example 2.

A carrier core material having an average particle diameter of 30.3 μm was obtained by the same method as in comparative example 1 except that the calcination temperature was set to 1110° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 14 shows a SEM photograph of the carrier core material in comparative example 2.

Comparative Example 3

Figure 15:
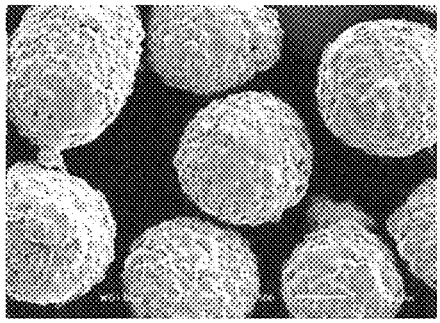
FIG. 15 A partially enlarged SEM photograph of a carrier core material in comparative example 3.

A carrier core material having an average particle diameter of 28.9 μm was obtained by the same method as in comparative example 1 except that the calcination temperature was set to 1120° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 15 shows a SEM photograph of the carrier core material in comparative example 3.

Comparative Example 4

Figure 16:
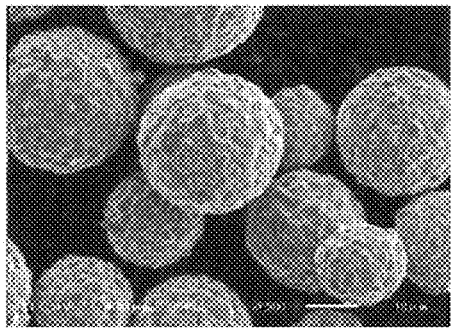
FIG. 16 A partially enlarged SEM photograph of a carrier core material in comparative example 4.

A carrier core material having an average particle diameter of 26.0 μm was obtained by the same method as in example 1 except that as the Mn component raw material, $Mn_3O_4$ ("Mox-Pu" made by Mizushima Ferroalloy Co., Ltd., graphite content: 0.58 wt %) was used, that the individual component raw materials were subjected to milling/mixing processing and were thereafter pre-calcined under the atmosphere at 750° C. and that they were put into the dispersion medium so as to produce the slurry. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 16 shows a SEM photograph of the carrier core material in comparative example 4.

Comparative Example 5

Figure 17:
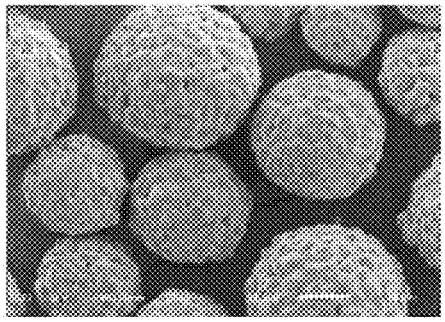
FIG. 17 A partially enlarged SEM photograph of a carrier core material in comparative example 5.

A carrier core material having an average particle diameter of 26.2 μm was obtained by the same method as in comparative example 4 except that the pre-calcination temperature was set to 900° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 17 shows a SEM photograph of the carrier core material in comparative example 5.

Comparative Example 6

Figure 18:
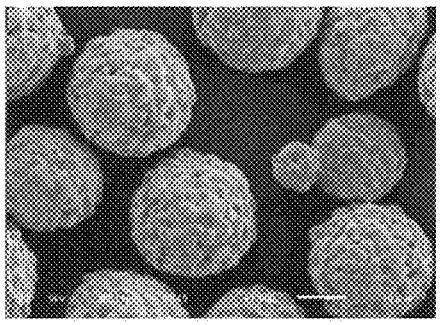
FIG. 18 A partially enlarged SEM photograph of a carrier core material in comparative example 6.

A carrier core material having an average particle diameter of 30.0 μm was obtained by the same method as in comparative example 4 except that the pre-calcination temperature was set to 1000° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 18 shows a SEM photograph of the carrier core material in comparative example 6.

Comparative Example 7

Figure 19:
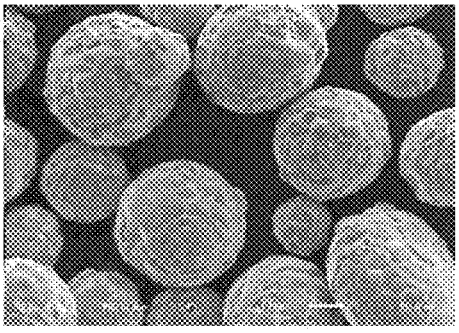
FIG. 19 A partially enlarged SEM photograph of a carrier core material in comparative example 7.

A carrier core material having an average particle diameter of 35.4 μm was obtained by the same method as in example 7 except that as the Mn component raw material, $Mn_3O_4$ ("Mox-Pu" made by Mizushima Ferroalloy Co., Ltd., graphite content: 0.63 wt %) was used and that the calcination temperature was set to 1200° C. The composition, the magnetic property, the physical properties and the like of the obtained carrier core material were measured with methods described later. The scattering of the carrier when the developer was obtained was evaluated. The results of the measurement and the evaluation are shown in tables 1 and 2. FIG. 19 shows a SEM photograph of the carrier core material in comparative example 7.

(Composition Analysis)

(Analysis of Fe)

The carrier core material containing iron element was weighed and dissolved in mixed acid water of hydrochloric acid and nitric acid. This solution was evaporated to dryness and was thereafter dissolved again by adding sulfuric acid water thereto, and thus excessive hydrochloric acid and nitric acid were volatilized. Solid aluminum was added to this solution, and thus all $Fe^{3+}$ ions in the liquid were reduced to $Fe^{2+}$ ions. Then, the amount of $Fe^{2+}$ ions in this solution was subjected to potentiometric titration using a potassium permanganate solution, and thus quantitative analysis was performed, with the result that the titer of Fe ($Fe^{2+}$) was determined.

(Analysis of Mn)

For the content of Mn in the carrier core material, quantitative analysis was performed according to a ferromanganese analysis method (potentiometric titration method) described in JIS G 1311-1987. The content of Mn in the carrier core material described in the invention of the present application is the amount of Mn which was obtained by performing the quantitative analysis with the ferromanganese analysis method (potentiometric titration method).

(Analysis of Mg)

The content of Mg in the carrier core material was analyzed by the following method. The carrier core material according to the invention of the present application was dissolved in an acid solution, and quantitative analysis was performed by ICP. The content of Mg in the carrier core material described in the invention of the present application is the amount of Mg which was obtained by performing the quantitative analysis with ICP.

(Analysis of Ca and Sr)

The contents of Ca and Sr in the carrier core material were determined by quantitative analysis with ICP as in the analysis of Mg.

(Apparent Density)

The apparent density of the carrier core material was measured according to JIS Z 2504.

(Fluidity)

The fluidity of the carrier core material was measured according to JIS Z 2502.

(Average Particle Diameter)

The average particle diameter of the carrier core material was measured with a laser diffraction type particle size distribution measuring device ("Microtrac Model 9320-X100" made by Nikkiso Co., Ltd.).

(Magnetic properties)

A room-temperature dedicated vibration sample type magnetometer (VSM) ("VSM-P7" made by Toei Industry Co., Ltd.) was used to apply an external magnetic field in a range of 0 to $79.58\times10^4$ A/m (10000 oersteds) continuously in one cycle, and thus residual magnetization $\sigma_r$ and magnetization $\sigma_{1k}$ ($Am^2/kg$) in a magnetic field of $79.58\times10^3$ A/m (1000 oersteds) were measured.

(Measurement of Average Length RSm)

The average length RSm of the carrier core material particles was measured as follows. An ultra-deep color 3D shape measuring microscope ("VK-X100" made by Keyence Corporation) was used to observe the surface with a 100× objective lens, and thus the average length RSm was determined. Specifically, ferrite particles were first fixed to an adhesive tape whose surface was flat, a measurement view was determined with the 100× objective lens, thereafter an autofocus function was used to adjust a focal point to the surface of the adhesive tape and an auto-shooting function was used to capture the three-dimensional shape of the surface of the ferrite particles.

Figure 20:
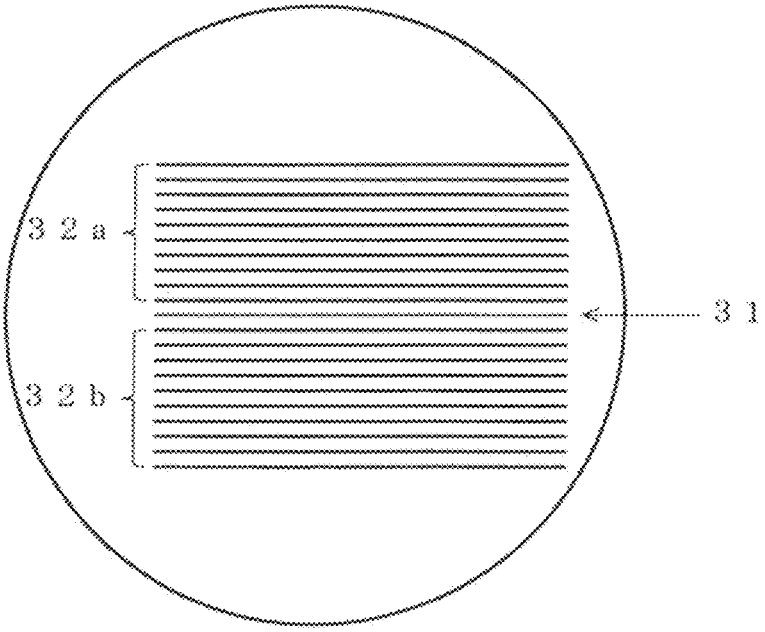
FIG. 20 An example of an observed screen of an ultra-deep color 3D shape measuring microscope.

The measurements of individual parameters were performed with software VK-H1XA attached to the device. First, as preprocessing, portions which were used for analysis were taken out of the obtained three-dimensional shape of the surface of the carrier core material particles. FIG. 20 shows a schematic view of an observed screen. In a center portion of the surface of the carrier core material particles, a line segment 31 whose length was 15.0 μm and which was extended in a horizontal direction was drawn, to each of the upper and lower portions thereof, 10 parallel lines at intervals of 0.75 μm were added and a total of 21 roughness curves on the line segment were taken. In FIG. 20, the 10 line segments 32*a* on the upper side and the 10 line segments 32*b* on the lower side are schematically shown.

Since the carrier core material particle was formed substantially in the shape of a sphere, the roughness curve taken had a given curvature as a background. Hence, as the correction of the background, the optimal quadratic curve was fitted and was subtracted from the roughness curve. In this case, a cutoff value λs was set to 0.25 μm, and a cutoff value λc was set to 0.08 mm.

A combination of a trough and a peak in the roughness curve was specified to be one element, and the average length RSm was obtained by averaging the lengths of the individual elements.

The measurement of the average length RSm described above was performed according to JIS B0601 (2001 edition).

The average particle diameter of the carrier core material particles used for analysis was limited to be 32.0 to 34.0 μm. As described above, the average particle diameter of the carrier core material particles which was the target to be measured was limited to a narrow range, and thus it is possible to reduce an error caused by a residue produced in curvature correction. As the average value of each parameter, the average value in 30 particles was used.

(Production of Developer)

A carrier was produced by coating the surface of the obtained carrier core material with a resin. Specifically, 450 weight parts of silicone resin and 9 weight parts of (2-aminoethyl) aminopropyl trimethoxysilane were dissolved in 450 weight parts of toluene serving as a solvent, and thus a coat solution was produced. The coat solution was applied with a fluidized bed-type coating device to 50000 weight parts of the carrier core material and was heated with an electric furnace whose temperature was 300° C., and thus the carrier was obtained. Likewise, in all examples and comparative examples which will be described below, the carrier was obtained.

The obtained carrier and a toner whose average particle diameter was about 5.0 μm were mixed with a pot mill for a predetermined time, and thus a two-component electrophotographic developer was obtained. In this case, the carrier and the toner were adjusted such that weight of the toner/(weight of the toner and the carrier)=5/100. Likewise, in all examples and comparative examples which will be described below, the developer was obtained. The obtained developer was put into the development device of a structure shown in FIG. 21 (the peripheral speed of a development sleeve Vs: 406 mm/sec, the peripheral speed of a photosensitive drum Vp: 205 mm/sec and a photosensitive drum-to-development sleeve distance: 0.3 mm).

(Evaluation of Carrier Scattering)

1000 white sheets of A4-size were printed, then the number of black spots on the 1000th sheet was visually measured and evaluation was performed with the following criteria. The results are also shown in table 2.

"©": no black spots

"○": 1 to 5 black spots

"Δ": 6 to 10 black spots

"×": 11 or more black spots

TABLE 1

| | Composition (preparation) | | | | | Pre-calcination conditions | | Mn raw material | Calcination conditions | | | Oxidization conditions | |
|---|---|---|---|---|---|---|---|---|---|---|---|---|---|
| | $Fe_2O_3$ mol | MnO mol | MgO mol | CaO mol | SrO mol | Temperature ° C. | Atmosphere ppm | Graphite content (%) | Temperature ° C. | Atmosphere ppm | Cooling zone ppm | Temperature ° C. | Atmosphere ppm |
| Example 1 | 42.6 | 38.3 | 5.7 | 0.5 | 0 | — | — | 0.01 | 1100 | 12000 | 12000 | 500 | 210000 |
| Example 2 | 42.6 | 38.3 | 5.7 | 0.5 | 0 | — | — | 0.01 | 1110 | 12000 | 12000 | 500 | 210000 |
| Example 3 | 42.6 | 38.3 | 5.7 | 0.5 | 0 | — | — | 0.01 | 1120 | 12000 | 12000 | 500 | 210000 |
| Example 4 | 42.6 | 38.3 | 5.7 | 0.5 | 0 | — | — | 0.42 | 1100 | 210000 | 12000 | 500 | 210000 |
| Example 5 | 42.6 | 38.3 | 5.7 | 0.5 | 0 | — | — | 0.42 | 1110 | 210000 | 12000 | 500 | 210000 |
| Example 6 | 42.6 | 38.3 | 5.7 | 0.5 | 0 | — | — | 0.42 | 1120 | 210000 | 12000 | 500 | 210000 |
| Example 7 | 54.8 | 44.7 | 0 | 0 | 0.5 | — | — | 0.25 | 1100 | 210000 | 7000 | 400 | 210000 |
| Example 8 | 54.8 | 44.7 | 0 | 0 | 0.5 | — | — | 0.25 | 1120 | 210000 | 7000 | 400 | 210000 |
| Example 9 | 54.8 | 44.7 | 0 | 0 | 0.5 | — | — | 0.25 | 1140 | 210000 | 7000 | 400 | 210000 |
| Example 10 | 50.0 | 38.0 | 11.0 | 0 | 0.7 | — | — | 0.57 | 1095 | 210000 | 7000 | 470 | 210000 |
| Example 11 | 50.0 | 38.0 | 11.0 | 0 | 0.7 | — | — | 0.57 | 1105 | 210000 | 7000 | 470 | 210000 |
| Example 12 | 50.0 | 38.0 | 11.0 | 0 | 0.7 | — | — | 0.57 | 1115 | 210000 | 7000 | 470 | 210000 |
| Comparative example 1 | 42.6 | 38.3 | 5.7 | 0.5 | 0 | — | — | 0.42 | 1100 | 12000 | 12000 | 500 | 210000 |
| Comparative example 2 | 42.6 | 38.3 | 5.7 | 0.5 | 0 | — | — | 0.42 | 1110 | 12000 | 12000 | 500 | 210000 |
| Comparative example 3 | 42.6 | 38.3 | 5.7 | 0.5 | 0 | — | — | 0.42 | 1120 | 12000 | 12000 | 500 | 210000 |
| Comparative example 4 | 42.6 | 38.3 | 5.7 | 0.5 | 0 | 750 | 210000 | 0.58 | 1120 | 12000 | 12000 | 500 | 210000 |
| Comparative example 5 | 42.6 | 38.3 | 5.7 | 0.5 | 0 | 900 | 210000 | 0.58 | 1120 | 12000 | 12000 | 500 | 210000 |
| Comparative example 6 | 42.6 | 38.3 | 5.7 | 0.5 | 0 | 1000 | 210000 | 0.58 | 1120 | 12000 | 12000 | 500 | 210000 |
| Comparative example 7 | 54.8 | 44.7 | 0 | 0 | 0.5 | — | — | 0.63 | 1200 | 210000 | 7000 | 400 | 210000 |

TABLE 2

| | Composition (wt96) | | | | | Magnetic properties | | Powder properties | | | | | Rsm | | |
|---|---|---|---|---|---|---|---|---|---|---|---|---|---|---|---|
| | Fe | Mn | Mg | Ca | Sr | σ 1000 $Am^2/kg$ | σr $Am^2/kg$ | Apparent density ($g/cm^3$) | Fluidity (sec) | Average particle diameter (μm) | BET $m^2/g$ | Pore volume $cm^2/g$ | Rsm average value μm | Rsm 8 μm or more frequency % | Carrier scattering amount |
| Example 1 | 48.6 | 20.7 | 1.4 | 0.2 | 0 | 50.0 | 2.0 | 2.06 | 35.1 | 27.1 | 0.200 | 0.016 | 5.6 | 0 | ○ |
| Example 2 | 48.6 | 20.8 | 1.5 | 0.2 | 0 | 56.2 | 1.1 | 2.14 | 34.5 | 28.3 | 0.190 | 0.016 | 5.7 | 1.2 | © |
| Example 3 | 48.6 | 20.8 | 1.5 | 0.2 | 0 | 54.5 | 1.7 | 2.15 | 35.0 | 26.1 | 0.172 | 0.013 | 5.7 | 0.4 | © |
| Example 4 | 48.6 | 20.8 | 1.5 | 0.2 | 0 | 55.0 | 1.6 | 2.05 | 41.2 | 30.1 | 0.217 | 0.020 | 6.1 | 0.4 | ○ |
| Example 5 | 48.6 | 20.8 | 1.5 | 0.2 | 0 | 55.5 | 1.4 | 2.16 | 39.8 | 29.8 | 0.201 | 0.019 | 6.1 | 0.8 | © |
| Example 6 | 49.6 | 20.6 | 1.4 | 0.2 | 0 | 58.7 | 1.0 | 2.10 | 38.6 | 30.2 | 0.190 | 0.018 | 6.2 | 1.9 | ○ |
| Example 7 | 53.0 | 20.3 | 0 | 0 | 0.6 | 66.5 | 1.2 | 2.30 | 34.1 | 35.6 | 0.220 | 0.010 | 5.8 | 1.5 | ○ |
| Example 8 | 52.4 | 20.5 | 0 | 0 | 0.6 | 68.2 | 1.2 | 2.38 | 33.3 | 36.0 | 0.203 | 0.007 | 5.8 | 1.4 | ○ |
| Example 9 | 52.5 | 20.4 | 0 | 0 | 0.6 | 69.0 | 1.3 | 2.43 | 33.1 | 35.1 | 0.180 | 0.003 | 5.8 | 0.9 | ○ |
| Example 10 | 50.2 | 37.7 | 11.2 | 0 | 0.7 | 60.1 | 0.9 | 2.25 | 32.3 | 38.2 | 0.221 | 0.012 | 5.6 | 1.4 | ○ |
| Example 11 | 50.1 | 37.8 | 11.2 | 0 | 0.7 | 60.4 | 1.0 | 2.25 | 33.4 | 37.3 | 0.213 | 0.014 | 5.5 | 1.7 | ○ |
| Example 12 | 50.2 | 37.7 | 11.2 | 0 | 0.7 | 61.2 | 1.1 | 2.23 | 31.2 | 38.5 | 0.198 | 0.008 | 5.5 | 1.1 | ○ |
| Comparative example 1 | 48.6 | 20.8 | 1.5 | 0.2 | 0 | 55.3 | 1.6 | 2.08 | 48.1 | 30.2 | 0.169 | 0.031 | 6.2 | 4.2 | X |
| Comparative example 2 | 49.0 | 19.9 | 1.4 | 0.2 | 0 | 58.8 | 0.8 | 2.13 | 45.5 | 30.3 | 0.167 | 0.023 | 6.1 | 5.0 | X |
| Comparative example 3 | 47.0 | 19.8 | 1.3 | 0.2 | 0 | 49.4 | 2.6 | 2.13 | 46.2 | 28.9 | 0.158 | 0.019 | 6.4 | 7.0 | X |
| Comparative example 4 | 48.6 | 20.8 | 1.5 | 0.2 | 0 | 59.1 | 0.9 | 2.13 | 42.4 | 26.0 | 0.158 | 0.015 | 5.4 | 3.1 | Δ |
| Comparative example 5 | 48.4 | 20.9 | 1.5 | 0.2 | 0 | 52.2 | 2.1 | 2.20 | 35.6 | 26.2 | 0.150 | 0.007 | 6.5 | 13.2 | X |
| Comparative example 6 | 48.7 | 20.7 | 1.5 | 0.2 | 0 | 56.6 | 1.3 | 2.05 | 48.6 | 30.0 | 0.111 | 0.025 | 7.2 | 20.1 | X |
| Comparative example 7 | 52.6 | 20.4 | 0 | 0 | 0.6 | 70.0 | 1.3 | 2.43 | 26.8 | 35.4 | 0.101 | 0.001 | 8.0 | 30.0 | Δ |

As is clear from table 2, in the carrier core materials of examples 1 to 3 in which as the Mn component raw material, $Mn_2O_3$ whose graphite content was so low as to be 0.01 wt % was used, the average value of the lengths RSm of the grains appearing on the surface of the carrier core material particles was 5.6 to 5.7 μm, and the frequency of the grain whose RSm was equal or more than 8.0 μm was equal to or less than 1.2 number percent. In the developers using such carrier core materials, there was no problem in practical use for the scattering of the carrier.

Even in the carrier core materials of examples 4 to 12 in which as the Mn component raw material, $Mn_3O_4$ whose graphite content was so high as to be 0.25 to 0.57 wt % was used, the concentration of oxygen in the temperature increasing step in the calcination step and the step of holding the calcination temperature was set to 210000 ppm, and the concentration of oxygen in the cooling step was set to 12000 ppm, with the result that the average value of the lengths RSm of the grains appearing on the surface of the carrier core material particles was 5.5 to 6.2 μm, and that the frequency of the grain whose RSm was equal or more than 8.0 μm was equal to or less than 1.9 number percent. In the developers using such carrier core materials, there was no problem in practical use for the scattering of the carrier.

By contrast, in the carrier core materials of comparative examples 1 to 6 in which as the Mn component raw material, $Mn_3O_4$ whose graphite content was so high as to be equal to or more than 0.42 wt % was used, and in which the concentration of oxygen in all the temperature increasing step in the calcination step, the step of holding the calcination temperature and the cooling step was set to 12000 ppm, the frequency of the grain whose RSm was equal or more than 8.0 μm was equal to or more than 3.1 number percent. In the developers using such carrier core materials, the scattering of the carrier was at such a level that there was a problem in practical use.

In the carrier core material of comparative example 7 in which as the Mn component raw material, $Mn_3O_4$ whose graphite content was so high as to be equal to or more than 0.63 wt % was used, in which the concentration of oxygen in the temperature increasing step in the calcination step and the step of holding the calcination temperature was set to 210000 ppm, in which the concentration of oxygen in the cooling step was set to 12000 ppm and in which the calcination temperature was set to 1200° C., the average value of the lengths RSm of the grains exceeded 8.0 μm, and the calcination temperature was high, with the result that it is found that the grains were excessively grown. Thus, coat separation easily occurs at the time of running, and in the developers using such a carrier core material, the scattering of the carrier was at such a level that there was a problem in practical use.

INDUSTRIAL APPLICABILITY

Since in the carrier core material according to the present invention, a specific concave-convex shape is uniformly formed in the surface, the degradation of a carrier caused by use is significantly reduced, with the result that it is possible to use it for a long period of time. The carrier core material is useful because stable charging performance is maintained and the cracking or chipping of particles is prevented from occurring.

REFERENCE SIGNS LIST

3 development roller
5 photosensitive drum

The invention claimed is:

1. A carrier core material that includes, a main component, a material which is represented by a composition formula $Mn_XM_YFe_{3-(X+Y)}O_4$ (where M is at least one type of metal selected from a group consisting of Mg, Ti, Cu, Zn and Ni, $0<X$, $0\leq Y$, $0<X+Y<1$), wherein 0.1 to 1.0 mol % of at least one of Sr element and Ca element is contained as a total amount by conversion to SrO or CaO, and a frequency of a grain whose length RSm is equal or more than 8.0 μm among grains appearing on a surface of particles of the carrier core material is equal to or less than 2.0 number percent.

2. The carrier core material according to claim 1, wherein an average value of lengths RSm of the grains appearing on the surface of the particles of the carrier core material falls within a range which is equal to or more than 5.5 μm but equal to or less than 6.3 μm.

3. The carrier core material according to claim 1, wherein a volume average particle diameter is equal to or more than 20 μm but equal to or less than 40 μm.

4. The carrier core material according to claim 1, wherein a BET specific surface area falls within a range which is equal to or more than 0.170 $m^2/g$ but less than 0.225 $m^2/g$.

5. The carrier core material according to claim 1, wherein a pore volume is equal to or more than 0.003 $cm^3/g$ but equal to or less than 0.020 $cm^3/g$.

6. The carrier core material according to claim 1, wherein a fluidity falls within a range which is equal to or more than 30 sec/50 g but less than 42 sec/50 g.

7. An electrophotographic development carrier, wherein a surface of the carrier core material according to claim 1 is coated with a resin.

8. An electrophotographic developer comprising:

the electrophotographic development carrier according to claim 7; and a toner.

* * * * *